US007721472B2

(12) United States Patent
Buhr et al.

(10) Patent No.: US 7,721,472 B2
(45) Date of Patent: May 25, 2010

(54) FINE SEDIMENT REMOVAL ATTACHMENT FOR A DREDGE

(75) Inventors: Victor Joseph Buhr, Holmen, WI (US); Mark Anthony Binsfeld, La Crosse, WI (US)

(73) Assignee: J.F. Brennan Co., Inc., LaCrosse, WI (US)

( * ) Notice: Subject to any disclaimer, the term of this patent is extended or adjusted under 35 U.S.C. 154(b) by 457 days.

(21) Appl. No.: 11/626,643

(22) Filed: Jan. 24, 2007

(65) Prior Publication Data

US 2008/0172911 A1 Jul. 24, 2008

(51) Int. Cl.
*E02F 3/88* (2006.01)

(52) U.S. Cl. ..... 37/317; 37/308; 37/318; 37/319; 37/326; 37/331

(58) Field of Classification Search ..... 37/317, 37/308, 311, 318, 319, 326, 329, 330, 334, 37/331

See application file for complete search history.

(56) References Cited

U.S. PATENT DOCUMENTS

| | | | | |
|---|---|---|---|---|
| 2,204,584 | A * | 6/1940 | Flower | 119/235 |
| 3,670,514 | A * | 6/1972 | Breston et al. | 405/160 |
| 3,995,439 | A * | 12/1976 | Hahlbrock | 405/161 |
| 4,327,506 | A * | 5/1982 | Bos | 37/325 |
| 4,914,841 | A * | 4/1990 | Weinrib | 37/195 |
| 5,146,699 | A * | 9/1992 | Lipford | 37/319 |
| 5,561,922 | A * | 10/1996 | Lynch | 37/317 |
| 6,318,005 | B1 * | 11/2001 | Andre | 37/329 |
| 6,550,162 | B2 | 4/2003 | Price et al. | |
| 6,640,470 | B2 | 11/2003 | Chesner et al. | |
| 7,370,445 | B2 * | 5/2008 | Mijatovic | 37/318 |
| 2005/0060836 | A1 * | 3/2005 | Nielsen et al. | 15/353 |
| 2005/0268499 | A1 * | 12/2005 | Weinrib et al. | 37/326 |

* cited by examiner

*Primary Examiner*—Thomas A Beach
*Assistant Examiner*—Matthew R Buck
(74) *Attorney, Agent, or Firm*—Whyte Hirschboeck Dudek SC

(57) ABSTRACT

Contaminated fine sediment is removed from surfaces beneath a body of water by a shrouded, self-cleaning, wheel-guided, open suction attachment for a swinging ladder suction dredge with articulating capabilities. The attachment comprises a wheel-guided, suction assembly in which the slurry is contained in a shroud. The shroud is attached to a head plate, and is designed to both enclose the solid particles suspended as a result of the removal operation, and to direct the suspended material to the mouth of the suction pipe. Inside the area surrounded by the shroud is a gatling plate rotated by a hydraulic motor mounted just above the shroud and head plate.

10 Claims, 7 Drawing Sheets

FINE SEDIMENT REMOVAL ATTACHMENT FOR A DREDGE

FIELD OF THE INVENTION

This invention relates to the removal of sediment from underwater environments. In one aspect, the invention relates to the removal of fine, contaminated sediment from marine, riparian and lake environments while in another aspect, the invention relates to the use of a swinging ladder, articulating hydraulic suction dredge for the removal of the sediment. In still another aspect, the invention relates to a shrouded, wheel-guided suction attachment for the dredge.

BACKGROUND OF THE INVENTION

Sediment removal from the bottom of natural and artificial bodies of water falls broadly into one of two camps, i.e., navigational and environmental. The primary purpose of the former is to create and/or maintain bodies of water open for navigation while the primary purpose of the latter is to remove sediment considered a threat to public health from a body of water.

Contaminated sediments can be removed by a number of different methods. One method is mechanical dredging using a modified clamshell bucket. These buckets use positioning devices to locate and extract sediment one bucket at a time. This method produces good results, but can be and often is time, equipment and manpower intensive.

Another method is hydraulic dredging which is commonly used in areas of shallow water. This is a more efficient means of removing material, but it often requires multiple passes to achieve designated decontamination levels. This method typically employs a cutter head or a horizontal auger to aid in the removal of these sediments. The cutter head dredge has advantages over the auger dredge due to its ability to follow contours when possessing articulating and swinging capabilities. This is an efficient and effective way to remove material, eliminating the need for dredge swing line anchors.

The horizontal auger also has its strengths. The auger can cover a wide swath of area at any given time, and to some degree, follow contours. However, large materials and debris can be very problematic for an auger due to the large distance materials must travel from the end of the auger to the suction pipe.

Both the cutter head and horizontal auger have difficulties with reducing the turbidity produced through dredging because to remove intended sediments, the sediments must first be agitated.

SUMMARY OF THE INVENTION

In one embodiment, the invention is a wheel-guided open suction attachment for a swinging ladder suction dredge with articulating capabilities, the attachment comprising a shrouded suction assembly mounted to a guiding wheel assembly. The shroud is attached to a head plate, and is designed to both enclose the solid particles suspended as a result of the removal operation, and to direct the suspended material to the mouth of the suction pipe. Inside the shroud is a gatling plate rotated by a hydraulic motor mounted just above the shroud and centered on the head plate.

The suction assembly comprises a length of pipe, or sections of pipe, that begins at a connection with the suction pipe or flexible hose from the suction dredge and terminates forward of the wheel assembly in a connection with the head plate above the shroud. The wheel assembly is located just behind the shroud and beneath the suction assembly. The wheel assembly comprises a heavy duty tire and rim assembly to move and position the suction attachment on and about the water body bottom, a wheel mount to connect the wheel assembly to the suction dredge, a load cell for measuring the amount of downward force experienced by the wheel, and a fork assembly comprising a plate on which the load cell is mounted.

In another embodiment, the invention is a suction attachment for a swinging ladder dredge, the attachment comprising:

A. Means for connecting the attachment to the swinging ladder of the dredge, the swinging ladder comprising a suction hose;

B. A suction assembly comprising a suction pipe one end of which is connected to and is in open communication with the suction hose, and the other end of which is connected to and in open communication with a head plate;

C. A gatling plate connected to and in open communication with the head plate and opposite the suction pipe, the gatling plate operated by a hydraulic motor mounted to the head plate opposite the gatling plate and adjacent to the suction pipe;

D. A shroud mounted about the gatling plate and beneath the head plate; and

E. A wheel assembly located behind the shroud and beneath the suction pipe, and connected to the swinging ladder.

In one particular embodiment, the dredge comprises a swinging ladder, articulated arm to which the attachment is connected. In another embodiment, the wheel assembly comprises a load cell to measure the amount of downward force the wheel is experiencing at any particular moment in time. In still other embodiments, the attachment comprises a maximizer assembly to prevent the pump from cavitating in situations where water is blocked from the suction pipe, and the gatling plate is equipped with a gatling shear to free accumulated sediments or materials that collect on the plate.

DESCRIPTION OF THE PREFERRED EMBODIMENT

Figure 1:
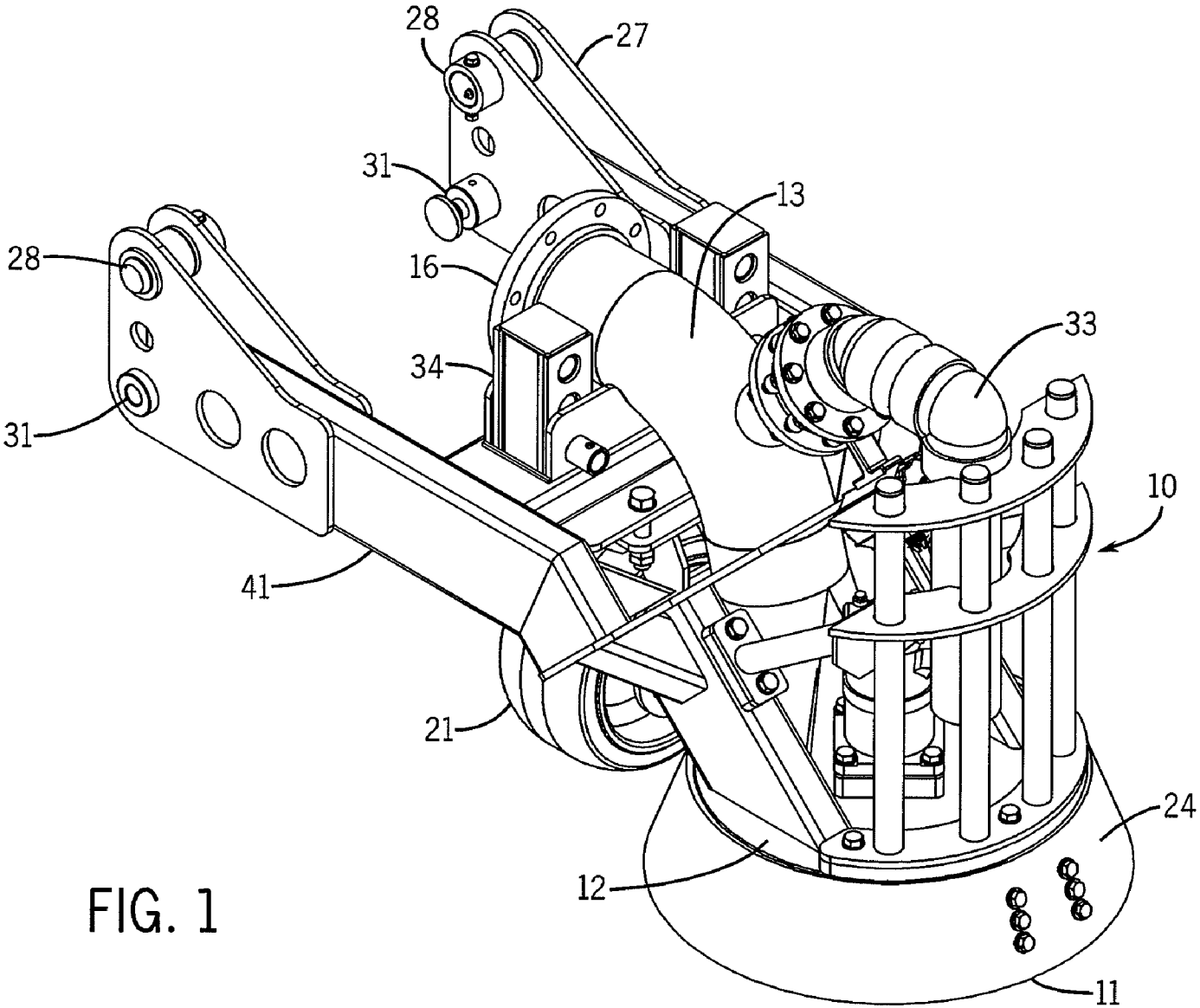
FIG. 1 is an isometric top view of one embodiment of a suction attachment of this invention.

The suction attachment of this invention is used to extract a wide range of sediment sizes ranging from gravel size (e.g., 8 millimeters) to clay size (e.g., 0.06 micrometers) from the bottom of water bodies while having minimal impact on the surrounding aqueous environment. The attachment is designed for use with existing swinging ladder, articulating dredge capabilities, and it allows the dredge to follow the contours of contaminated sediment models to efficiently and cost-effectively extract contaminated fine granule sediments while leaving heavier, non-contaminated material in place.

As a dredge passes across a contaminated site, residuals are commonly left behind. This may require the need for a second or even third pass to reduce contamination to within contract specified concentrations, which usually are very low, and this, of course, is very inefficient. Preferably, the intended goal of very low residuals is achieved in one pass through the use of the suction attachment of this invention.

Much of the contamination found in underwater environments is in the form of fine sediments and if disturbed, these sediments are easily suspended in the overlying water. In a contaminated sediment removal operation, this suspension of fine sediment is a common cause of the redistribution of the contaminated sediment. Cutter heads and auger dredges are well known for churning up the sediment layers and as such, are not well adapted for removing contaminated sediment. The suction attachment of this invention, however, reduces suspended solids as well as directs these solids into the suction pipe through the use of, among other things, a shroud. The apparatus of this invention removes the light sediments without inadvertently disturbing underlying sediments such as sand, gravel and clay. Instead, depending on the characteristics of the materials, the suction effects can be adjusted to remove primarily or only the intended sediments, while limiting any suspension due to their removal by avoiding contact with the material.

Typically, the removed material is dewatered and transported to landfills, and this process is very costly. If non-contaminated material is removed along with the targeted, contaminated material (intended or otherwise), then this non-contaminated material requires the same disposal methods as does the contaminated material. The fine sediment remediation, i.e., suction, attachment of this invention minimizes the amount of clean material removal by avoiding agitation that is caused by conventional cutter heads or augers. By adjusting pump speeds and swing rates, materials can be effectively removed according to their densities.

The suction attachment of this invention can be used to extract contaminated, fine sediments from the bottom of most water bodies, e.g., marine, river, lake and canal bottoms. This attachment increases the rate at which such water bodies can be suction dredged by increasing the efficiency at which the material can be extracted. Suction dredges with this attachment can cover more area in a specified amount of time while achieving a more successful end result in contamination clean-ups. The attachment will also reduce the cost of dewatering and disposing of contaminated sediments by reducing the amount of non-contaminated sediments that are inadvertently removed in the standard removal processes using cutter head and auger dredges.

The suction attachment of this invention will succeed in areas where conventional devices fail, or at least under-perform. For example, the attachment easily connects to a swinging ladder, articulating hydraulic suction dredge that does not require anchors for advancement. Moreover, the attachment encloses the target area in the shroud, thus reducing the amount of solids suspension in the water around the dredge.

Another advantage provided by the attachment is that it does not mechanically agitate the material it is removing. The soft sediments do not mix with the thicker or denser sediments as the material is removed. In this regard, the attachment acts like a vacuum cleaner by hovering over the targeted area and never coming into contact with the material until it is pulled from is resting place.

Referring to the Figures, suction attachment 10 comprises shroud 11 attached by any convenient means, e.g., welding, mechanical fasteners like screws or bolts, etc., to the underside of head plate 12. The shroud is used to accomplish two purposes in the function of the open suction attachment. One purpose is to surround or engulf most, if not all, solid particles placed into suspension during the removal operation. This reduces the area affected by dredge operations by controlling the re-settlement of the suspended solids. The other purpose is to direct the suspended solids into the mouth of suction pipe 13.

The foot-print of the shroud can vary to convenience and is dependent, in large part, on the size of the suction dredge to which it is attached. One size useful in remediating river bottoms measures about 0.775 meters (m, or 30.5 inches(in)) in diameter for a total enclosed area of about 0.47 square meters ($m^2$, or 5.1 square feet ($ft^2$)). The shroud can be made of any suitable material, e.g., rubber, metal, plastic, etc., and usually it has a robust thickness of about 1.27 centimeter (cm, or 0.5 in) to provide it with durability in underwater debris encounters. The configuration of the shroud can also vary widely, e.g., polygonal, circular, oval, etc., with a circular or oval configuration preferred.

Figure 6:
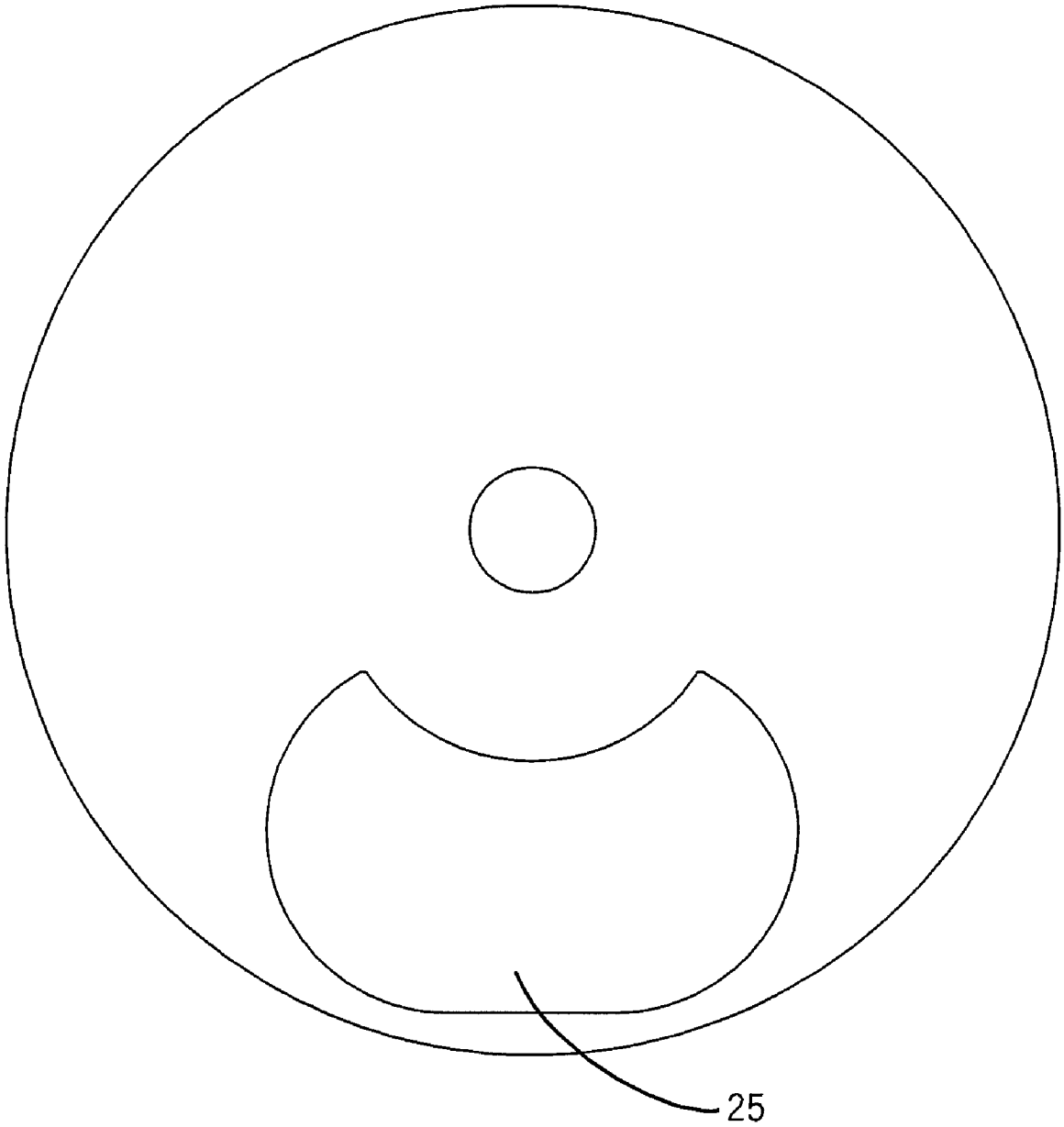
FIG. 6 is a top view of a modified head plate.

As noted above, the shroud is also designed to direct the suspended material into the mouth (not shown, but see FIG. 6) of suction pipe 13. The pipe is located as close to the center of the shroud as possible to create a consistent suction effect throughout its enclosed area. Additionally, a taper, e.g., 20 degrees measured from the top rim (i.e., the rim adjacent to the head plate) to the bottom rim of the shroud, aids in directing sediment into the mouth of suction pipe 13. The height of the shroud can also vary to convenience but with the diameter, thickness and taper previously described, a height of about 19.4 cm (7.6 in) keeps the suction pipe sufficiently spaced off the layers of sediment to reduce the potential for catching debris and pump cavitations. The shroud also protects rotating gatling plate 14 from contacting any underwater obstructions.

Suction pipe 13 begins above adjustable wheel assembly 21 and curves sharply down to head plate 12 and above shroud 11. The suction pipe approaches the head plate at an angle, e.g., 15 degrees, to allow room for hydraulic motor 15, and is in open communication with head plate 12, i.e., the head plate does not block the flow of sediment from the bottom of the water body into the suction pipe. In a preferred embodiment, the suction pipe has a fish-mouth end (not shown) for receiving the sediment, and this design facilitates placement of the suction pipe as close to the center of the head plate as possible (given that the center of head plate 12 is already occupied by hydraulic motor 15). The fish-mouth shaped end of suction pipe 13 is mated and welded or otherwise fastened over fish-mouth shaped opening 25 in head plate 12. The head plate comprises hydraulic motor pass-through or opening 26 at which point hydraulic motor 15 is attached for the operation of gatling plate 14.

Figure 7:
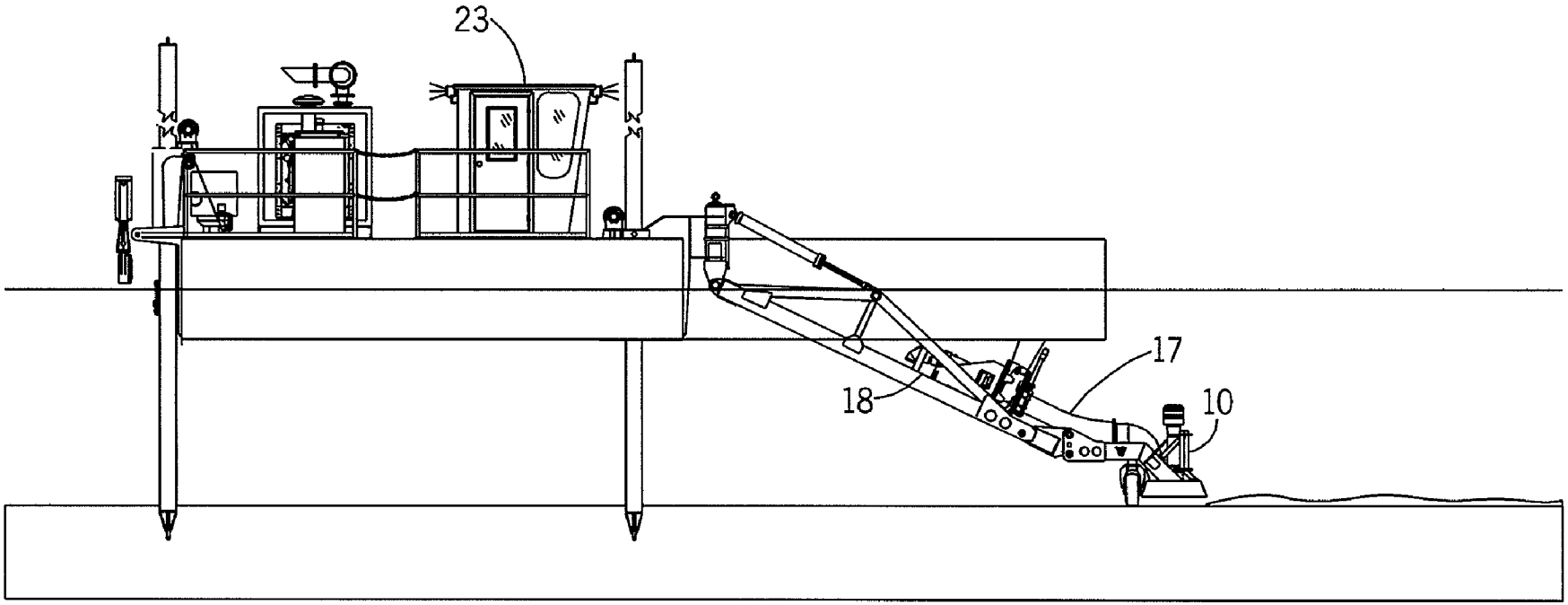
FIG. 7 is a side view schematic of a swinging ladder, articulating arm of a suction dredge equipped with the suction attachment of FIG. 1.

The end of the suction pipe opposite the end designed to receive the sediment comprises flange 16 designed to connect with flexible hose, pipe or other conduit 17 of swinging ladder 18 of dredge 43 (FIG. 7) to transport the sediment out of the body of water. The design, size and materials of construction of the suction pipe and flange can vary as desired but for use with a shroud as described above, the suction pipe may comprise several short lengths of 20 cm (8 in) diameter schedule 40 pipe and a long-run of 20 cm (8 in) diameter schedule 40 elbow. The flange for such a suction pipe would likely measure 20 cm (8 in) in diameter and have a minimum pressure rating of 10.34 bar (150 pounds per square inch (psi)).

Figure 4:
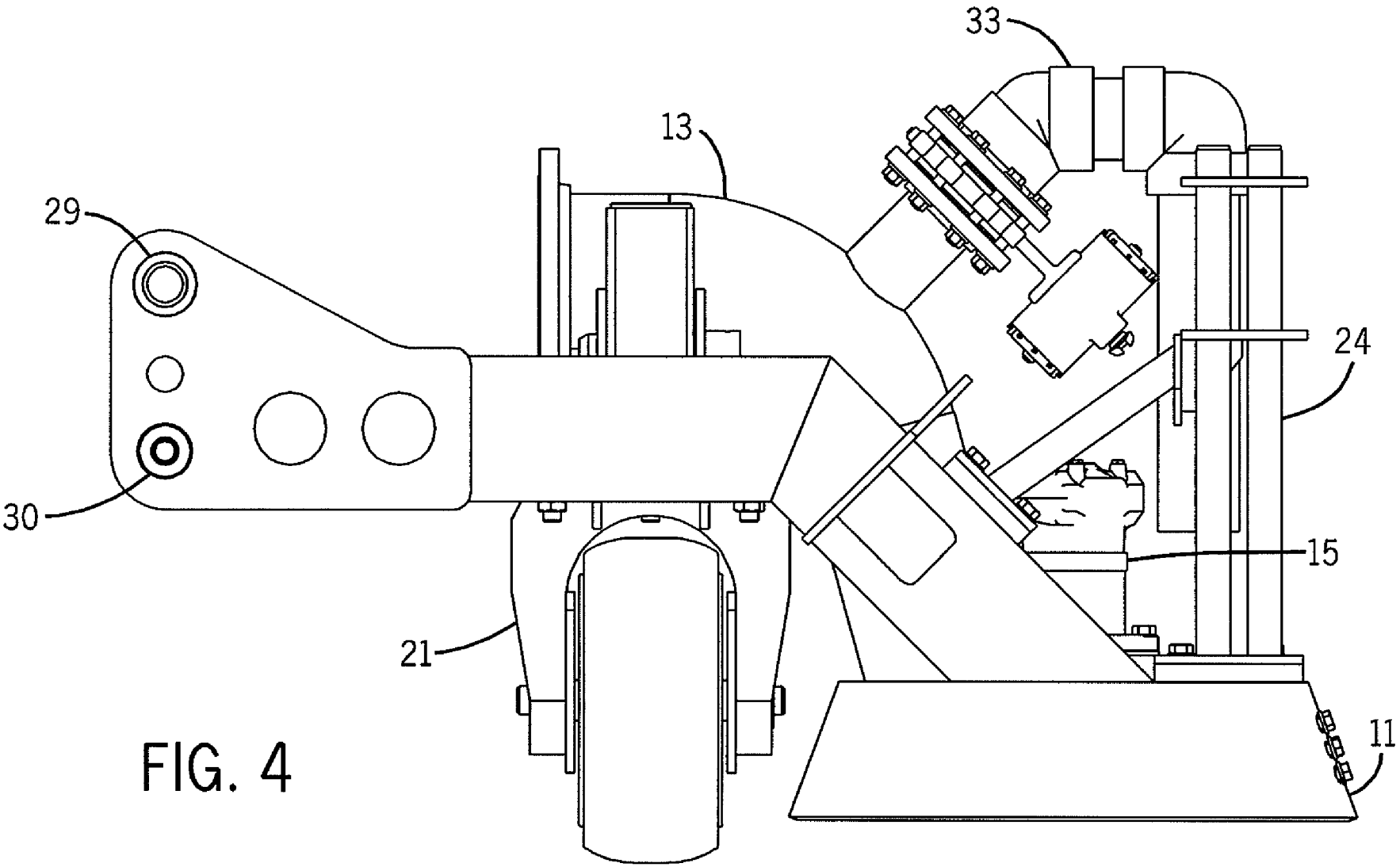
FIG. 4 is a side view of the suction attachment of FIG. 1.

Suction attachment 10 is connected to dredge ladder (or arm) 18 by ladder attachment assembly 27 and ladder connection pins 28 at ladder connection articulation points 29 (one on each arm of the assembly, FIG. 4) to form a rotating knuckle. Pins 28 allow the suction attachment to be articulated to a maximum angle of about 45 degrees, and this enables an operator of the dredge to keep the suction attachment parallel with the water body bottom to maximize its effectiveness. In addition, ladder attachment assembly 27 includes hydraulic cylinder connection points 30 (FIG. 4) at which a hydraulic cylinder (not shown) is attached to each arm of assembly 27 to enable rotation of the suction assembly. The cylinders are attached to the assembly by hydraulic cylinder pins 31.

Figure 3:
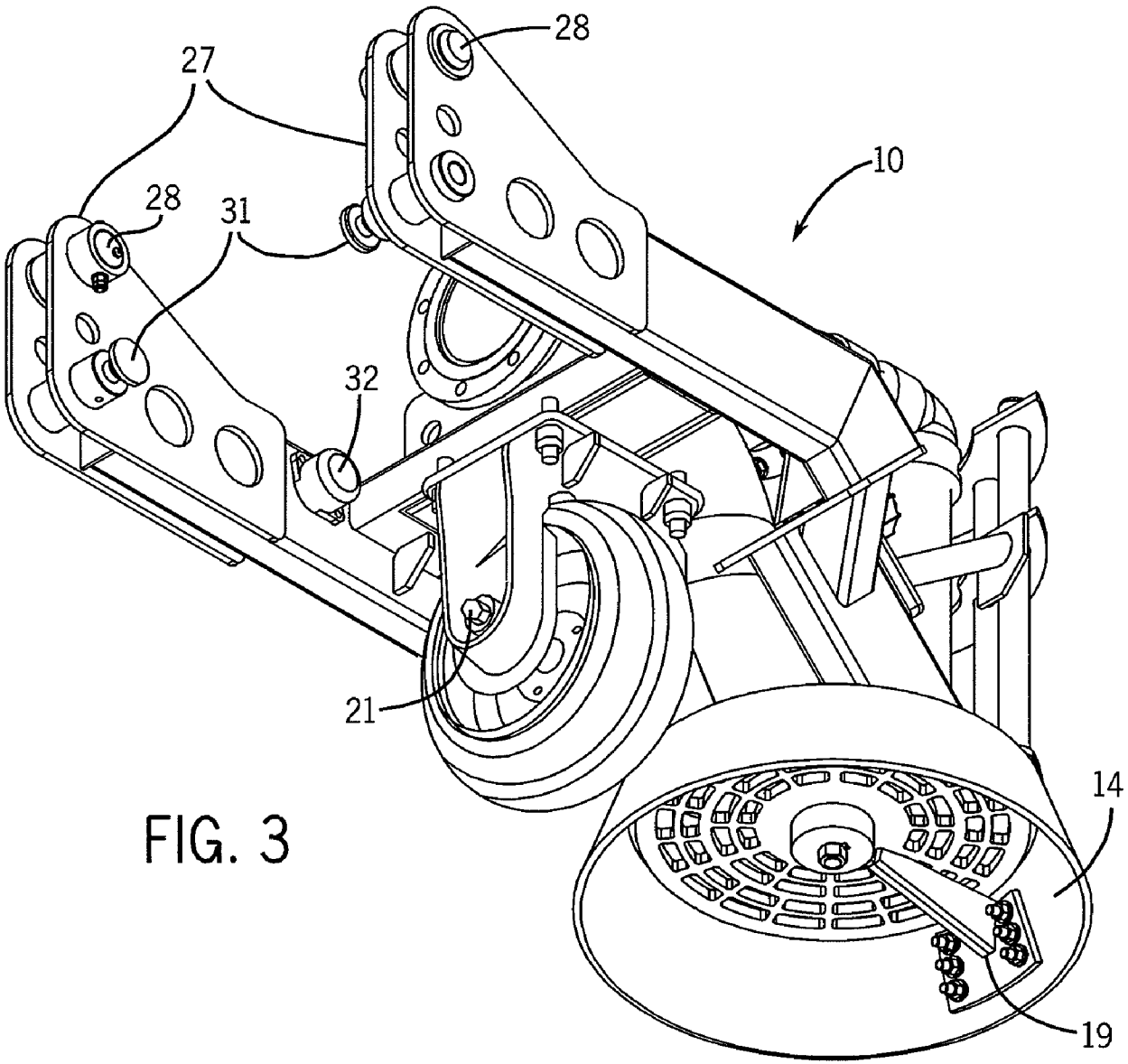
FIG. 3 is an isometric bottom view of the suction attachment of FIG. 1.

In one embodiment, inclinometer 32 (FIG. 3) is mounted on the suction attachment in a protected area, e.g., near and behind the wheel assembly, and this informs the operator if the angle of the suction attachment is not level to the water body bottom. The information is fed directly into a dredge operating computer for control of the articulation. Any sensor that can provide this information can be used in the practice of this invention, and the sensor that is standard on a Dredging Supply Company 8-inch Moray dredge articulating ladder is exemplary. The information is also provided to Dredgepack software available from Hypack, Inc. in which it is used to determine the final elevation of the suction attachment at any position.

Inside shroud 11 is gatling plate 14 that prohibits large rocks and debris from being caught in the dredge pump and pipeline (e.g., suction pipe and dredge hose). This is common industry practice, and the gatling plate acts as a screen allowing only materials of a designated size, e.g., 7.6 cm (3 in), to be removed. The gatling plate is rotated by the hydraulic motor mounted to the center of the head plate. Spinning this plate keeps debris from collecting around the mouth of the suction tube which generally results in pump cavitations. Gatling shear 19 is attached to the shroud opposite fish mouth opening 25. This shear frees accumulated sediments or materials that collect on the plate to avoid pump cavitation. The shear is fastened to the shroud typically with a series of six bolts in such a manner that a minimal space, e.g., 0.32 cm or 0.125 inches, exists between the spinning gatling plate and the fixed shear.

The gatling plate is made of a material of sufficient strength and thickness to operate in the underwater environment in which it is deployed. In one embodiment, the gatling plate measures 0.6 m (2 ft) in diameter and is made from 1.9 cm (0.75 inch) thick T-1 plate. Hub 20 (FIG. 4) passes through hydraulic motor pass-through 26 of the head plate and the gatling plate, and it attaches to the shaft (not shown) of the hydraulic motor. The motor is attached to the hub on the gatling plate by a tapered 57.2 mm (2.25 in) shaft. A standard SAE C flange (not shown) is used to mount the motor to the head plate of the suction attachment. The hydraulic motor is protected from collisions with underwater debris and potential sediment cave-ins by component guard 24.

The plate can spin at any convenient rate, and in one embodiment it spins at a maximum speed of about 30 revolutions per minute (rpm). In this embodiment, the gatling plate is spun by a Sauer Danfoss OMV800 hydraulic motor. This is an 800 cc motor that requires 23-27 liters per minute (LPM, 6-7 gallons per minute (GPM)) to achieve a speed of 30 rpm. This produces a torque of 300 Newton meter (Nm, or 2,500 pounds force-inch (lbf*in)). Since the apparatus is not intended to dig into the sediments, a low torque/low speed motor is appropriate.

In a preferred embodiment of this invention, maximizer assembly 33 is installed on the suction attachment to prevent dredge pump 42 from cavitating in situations in which water is blocked from the suction pipe as a result of debris. Dredge pump 42 is shown located on the swinging ladder, but it can be located at any convenient location on the dredge. One end of the maximizer assembly, typically an assemblage of pipes, elbows, flanges and valves, is open to the water, and the other end is in communication with the suction pipe. The communication between the maximizer assembly and the suction pipe is typically controlled by a valve, e.g., a butterfly valve. The valve is controlled by an operator, and it can be opened to allow water into the pump from a location on the attachment that is above the head plate and that is not buried in material.

Figure 5:
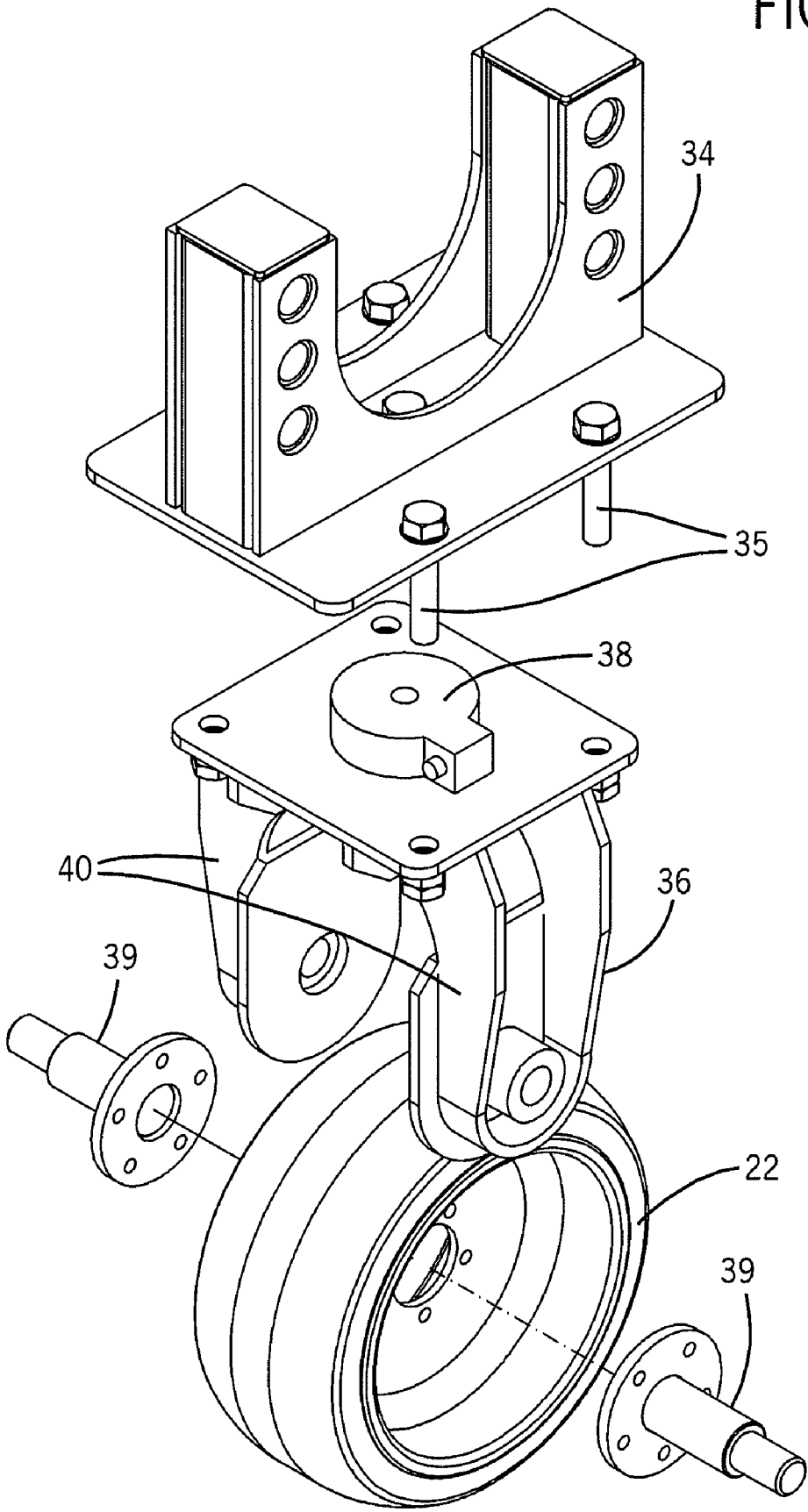
FIG. 5 is an exploded isometric top view of the wheel assembly.

High-strength, low-impact wheel assembly 21 (FIG. 5) is located just aft of the shroud and underneath the suction pipe. This assembly acts as a locator that allows for height adjustments to the suction attachment so that a desirable spacing between the bottom of the shroud and the hard bottom of the water body can be maintained, e.g., a spacing between about 7.62-22.86 cm (3-9 in). Wheel assembly 21 is adjustable to any number of positions, typically three, by adjustable pin mount 34, and in one embodiment, the height is secured in place with height mount pins 41.

Wheel assembly 21 includes a high strength, low impact tire and rim assembly (or, simply, wheel) 22 commonly used on all-terrain forklift equipment. One typical tire is a Mitco General Service solid rubber tire measuring 45.72×17.78×20.32 cm (18×7×8 in). One typical rim is a Mitco 20.32×11 cm (8×4.33 in) LR rim with a 0.953 cm (0.375 in) thick hub. The hub of this particular rim has a 5-hole lug pattern at a center diameter of 11.43 cm (4.5 in) to accept five bolts. Wheel 22 is attached to fork assembly by stub shafts 39 and wheel bushings 40.

In one embodiment, fork assembly 36 has fork plate 37 mounted on the top. This plate is used to center mount load cell or sensor 38 which is designed for measuring the amount of downward force that the wheel is experiencing at any given moment. Readout means (not shown) are located in operator or lever room 23 (FIG. 7) of the dredge, and it allows the operator to watch the load exerted on the wheel assembly measured by the load cell. By establishing a target load, the operator can raise or lower the dredge ladder to follow the bottom contours as well as reduce tendencies to bury the shroud in softer sediments.

The design of the load cell can vary widely, and a typical load cell for use in this invention is a Honeywell precision pancake load cell Model 41. This particular cell has a maximum capacity of 4,536 kg (10,000 lb) that measures in 4.54 kg (10 lb) increments. The center of the load cell consists of a threaded hole for a bolt, which enables it to measure tension and compression. A water-proof cable connects the load cell to a digital readout instrument (not shown) located in operator room 23. One digital readout useful in the practice of this invention is a Honeywell digital instrument model GM. This digital readout can function as both the signal amplifier and power source for the load cell.

Figure 2:
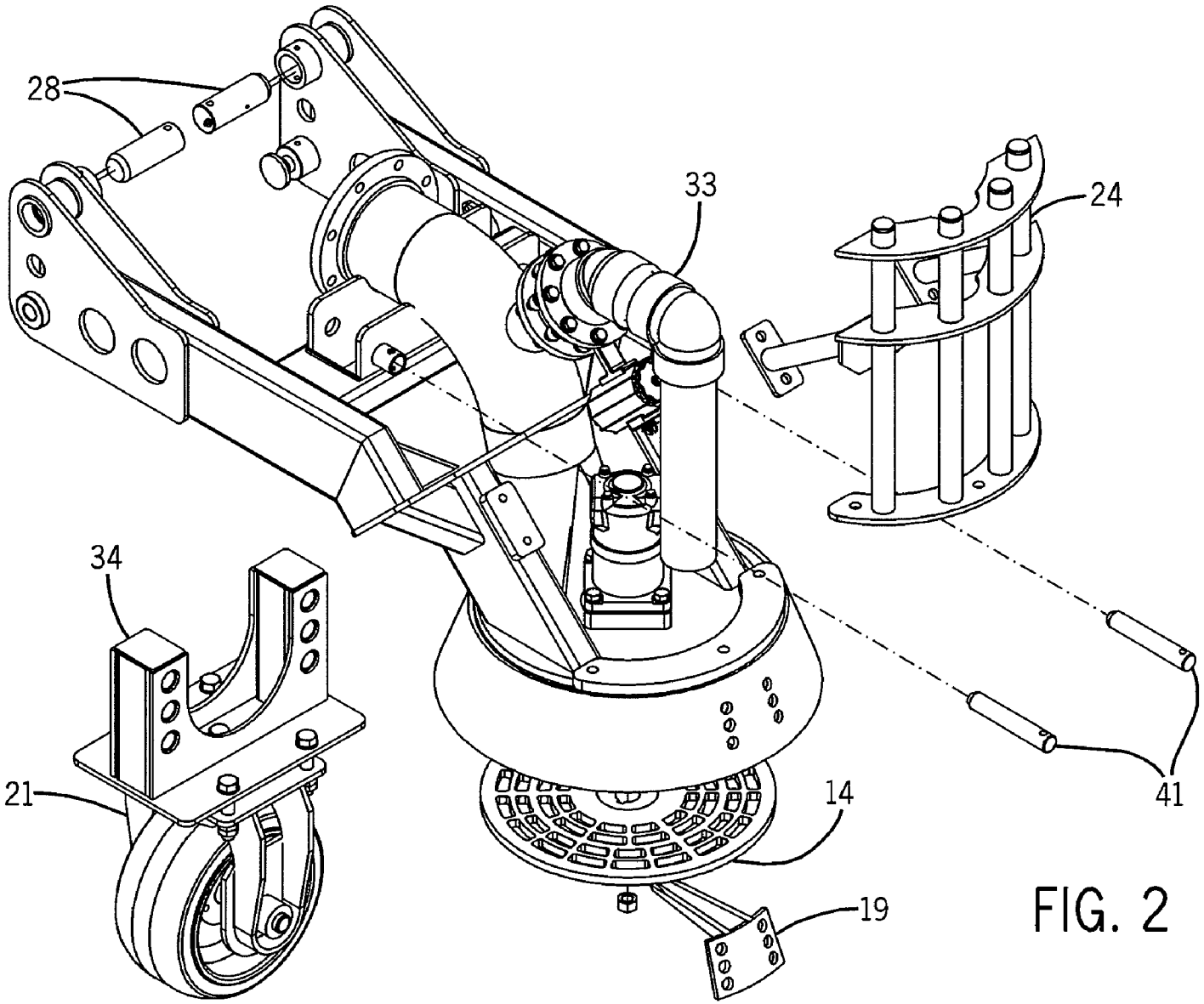
FIG. 2 is an exploded, isometric top view of the suction attachment of FIG. 1.

The adjustable pin mount is located above the load cell. This mounting unit is designed to fit around the suction pipe as well as to allow for height adjustments. It connects to the lower or fork assembly through wheel assembly fasteners 35 and through the load cell. Pins 41 which are shown in FIGS. 1 and 2 can connect the wheel assembly to the open suction unit structure. The entire wheel assembly may weigh 225 lbs or more requiring a special attachment to increase and decrease the wheel height. One such special attachment is an Y-shaped jacking bar that allows the operator to use a power wrench to adjust the height of the wheel quickly after the dredge ladder is raised above the surface of the water. This allows for timely adjustment during times when different sediment characteristics are experienced. Once the intended height is reached, pins 41 are inserted into the desired holes of adjustable pin mount 34 to attach the wheel assembly to the frame of the suction attachment, and to lock it into position.

The preferred operating conditions for this apparatus include a shallow subsurface face ranging from 7.62 cm-22.86 cm (3-9 inches) of fine sediment material layered on a hard clay or gravel bottom. Depth of the material below the water surface is inconsequential although the suction attachment works particularly well in depths up to 6 feet deep. Area coverage can average 2,323 $m^2$ (25,000 $ft^2$) in 24 hours using an attachment of the size described above. This area is a direct result of averaging and advance of 7.6 m (25 ft) an hour with a 15.2 m (50 ft) wide cut.

Preferably, line velocities are maintained at about 4,500 LPM (1200 GPM) to ensure no settlement of larger granule materials in the discharge line. This, of course, depends on the type of material being pumped as well as the distance it is being pumped.

In one preferred embodiment, the wheel height is set at 6 inches during a single pass. In this configuration a load of 227 kg (500 lb) or less is targeted for the wheel assembly. This ensures that the shroud will not dig into subsequent layers.

The contaminated fine sediment remedial attachment, or suction attachment, was tested in various ways to define preferred operating procedures. First, a pre-dredge survey was conducted to model an area that had ideal characteristics for the attachment. This area had a layer of soft sediment measuring 7.62-22.86 cm (3-9 inches) thick on top of a compact clay bottom. Polychlorinated biphenyls (PCB) tests were conducted to determine the level of contamination by a third party engineering firm. These PCB tests results ranged from 10-60 ppm.

A 24-hour period of dredging was scheduled before the first post-dredge survey. Operators were allowed to try different techniques to acclimate themselves with the unit. For instance, the dredge could cut a swath 18-feet wide if allowed only to cut one dredge set wide bound by the limits of the swinging ladder. By planting the wheel assembly, the operator could cover a 50-foot wide swath in 3 sets. This is a technique used with a standard cutter head attachment because it reduces the amount time necessary to relocate to new cuts.

In this period of time the "auto-level" setting was selected in the Dredging Supply Company on-board computer to ensure the attachment was always level. If an inclined slope was encountered, then the operator switched to a manual over-ride and adjusted the apparatus to a parallel above the lakebed. The operator was able to concentrate on the load cell readout to monitor how much force was being applied to the wheel. Initially a window of 454-680 kg (1000-1500 lbs) was the target, but this was soon changed to a target of 227 kg (500 lbs). The wheel is an indicator to let the operator know when it makes contact with the bottom and as such, a large force on the wheel is not necessary. As the force readout increased, the operator raised the dredge ladder. As the readout decreased, the operator lowered the dredge ladder. This enabled the operator to follow the contours of the lake bed more accurately. This, coupled with the use of Hypack Inc. Dredgepack software, allowed the operator to track and record the water body depths and locations continuously.

Three test passes were made with the suction attachment which is the number of passes required to remove the same sediment characteristics with a standard cutter head attachment. The results of the first test were measured using a hydrographic survey, core sampling, and an operational analysis. The survey and core samples showed that greater then 95% of the intended material was removed, achieving the project goals. More rock, however, was removed than initially planned. The rock was gravel-sized so it is not counted as contaminated sediment since the PCBs tend to bond with finer sediments. Because it was removed with the fine sediment, the rock was disposed of as if it where contaminated. To reduce the amount of rock, one pass replaced the initial three passes of the apparatus.

Twenty-four more hours were given to test the fine sediment remedial attachment using only one pass. Again, a hydrographic survey was made, and again more than 95% of the target contaminated sediment was removed but this time the gravel removal was greatly reduced.

The third day of testing used a different height adjustment setting on the apparatus. This wheel was set to a height of 6 inches. The intention here was to accelerate the pace at which the dredge was stepping forward, By increasing the swing speed of the dredge, it could cover more area in less time. The dredge increased its forward movement from 5.5, meters per hour to 7.6 meters per hour (from 18 to 25 feet per hour).

Results from the third day of testing were very positive. Final hydrographic survey, core sampling, and PCB tests found that greater than 95% of the intended material was removed and the PCB tests came back ranging from 0-0.17 ppm. This was decidedly better than the results achieved using a cutter head attachment which for the same area left PCB in the range of 0-8.2 ppm. This testing showed that the suction attachment was very effective in sediment removal. The removal exceeded expectations by not only increasing the effectiveness of the removal, but its efficiency as well. The dredge was soon afterwards averaging 2,323 $m^2$ (25,000 $ft^2$) a day compared to 1,672 m (18,000 $ft^2$) per day with a standard cutter head.

Turbidity was also compared to the standard cutter head dredge configuration. The test was conducted in an area where two identical dredges were operating, one with the fine sediment remedial attachment, and one with a standard cutter head attachment. Turbidity monitors were set downstream of both dredges to measure the Total Suspended Solids (TSS) amount and compare them to background measurements taken from an upstream location. The turbidity measurements were much lower downstream for the dredge with the suction attachment.

Visual turbidity inspections were also conducted due to the shallow water and high clay content of the river. The dredge with the standard cutter head attachment had a very visible turbidity cloud forming around the digging area. This was due to the agitation of clay sediment underlying the contaminated soft sediment. The dredge with the fine sediment remediation attachment had a minimal cloud which was difficult to perceive. In fact, the suction attachment was visible below the surface of the water at a depth of 4-5 feet.

The tests also identified two preferred variations in the construction and operation of the suction attachment. First, the dredge operator noticed that as he planted the attachment to swing to another step, the pump would often experience choking. This was due to burying the shroud in the sediment, and thus not allowing water to flow into the suction pipe. This problem was solved by installing a maximizer to the attachment to allow water to flow into the shroud through a pneumatic butterfly valve whenever the pump begins to cavitate. Maximizer assemblies are commonly found on sand and gravel dredges. These are designed to allow water passage into the dredge pump during cave-in situations that block water from the mouth of the suction pipe.

Although the invention has been described in considerable detail in the preceding specification and drawings, this detail is for the purpose of illustration. Those skilled in the art will recognize that the many variations and modifications can be made to the invention without departing from its spirit and scope as described in the appended claims.

What is claimed is:

1. A suction attachment for an open suction dredge, the attachment comprising:

A. means for connecting the attachment to the dredge;

B. an open suction assembly comprising a suction pipe one end of which is connected to a head plate;

C. a gatling plate connected to the head plate and opposite the suction pipe, the gatling plate operated and rotated by a hydraulic motor mounted to the head plate opposite the gatling plate and adjacent to the suction pipe;

D. a shroud mounted about the gatling plate and extending beneath the head plate and beyond the gatling plate; and E. a wheel assembly located behind the shroud and beneath the suction pipe.

2. The suction attachment of claim 1 in which the wheel assembly comprises a load cell.

3. The suction attachment of claim 2 in which suction assembly further comprises a gatling shear.

4. A suction dredge equipped with the suction attachment of claim 1.

5. A method of removing fine sediment from the surface of a bottom of a body of water, the method comprising employing a suction dredge equipped with the open suction attachment of claim 1.

6. A method of removing fine sediment from the surface of a bottom of a body of water, the method comprising employing a suction dredge equipped with the suction attachment of claim 2.

7. A method of removing fine sediment from the surface of a bottom of a body of water, the method comprising employing a suction dredge equipped with the suction attachment of claim 3.

8. The method according to claim 5 in which the shroud hovers over and pulls a sediment layer from its resting place with out mechanically agitating the sediment layer.

9. The method according to claim 8 in which the shroud hovers in a range of about 3 inches to about 9 inches above the sediment layer.

10. The suction attachment according to claim 1 wherein the shroud has a circular or oval configuration.

* * * * *